United States Patent [19]

Bauer

[11] 4,001,491

[45] Jan. 4, 1977

[54] ONE OR MULTI-PART COMPOSITE UMBRELLA-SHAPED INSULATOR

[75] Inventor: Ewald Bauer, Wunsiedel, Germany

[73] Assignee: Rosenthal Technik AG, Bavaria, Germany

[22] Filed: Nov. 6, 1975

[21] Appl. No.: 629,644

[30] Foreign Application Priority Data

Apr. 29, 1975 Germany ..... 2519007

[52] U.S. Cl. ..... 174/209; 29/631; 156/294; 174/179; 264/262

[51] Int. Cl.[2] ..... H01B 17/60; H01B 19/00

[58] Field of Search ..... 174/176, 177, 178, 179, 174/195, 209, 210, 212; 29/631; 156/293, 294, 303.1; 264/69, 71, 102, 262, DIG. 54

[56] References Cited

UNITED STATES PATENTS

| | | | |
|---|---|---|---|
| 2,732,423 | 1/1956 | Morrison | 174/209 |
| 3,904,724 | 9/1975 | Kipple et al. | 264/71 |

FOREIGN PATENTS OR APPLICATIONS

| | | | |
|---|---|---|---|
| 1,121,187 | 4/1956 | France | 174/179 |
| 1,133,006 | 11/1968 | United Kingdom | 174/179 |
| 1,224,626 | 3/1971 | United Kingdom | 174/179 |

*Primary Examiner*—Laramie E. Askin

*Attorney, Agent, or Firm*—Ostrolenk, Faber, Gerb & Soffen

[57] ABSTRACT

Composite insulator having a plurality of umbrella-shaped sections on a trunk; each section is comprised of a mould filled with a hardenable material which adheres to the mould and the trunk; shaping the mould to receive the hardenable material.

9 Claims, 3 Drawing Figures

ONE OR MULTI-PART COMPOSITE UMBRELLA-SHAPED INSULATOR

BACKGROUND OF THE INVENTION

The invention relates to disc or funnel-shaped, which will be referred to hereafter as composite umbrella-shaped, insulator sections formed of synthetic material and which are moulded onto a fiberglass reinforced supporting trunk; and the invention also relates to a method of fixing such umbrella-shaped insulator sections to the insulator trunk.

Composite insulators of synthetic material are comprised of a supporting trunk; or core and umbrella-shaped sections moulded thereon. The supporting trunk preferably assumes the mechanical and support functions, while the umbrellas, on the other hand, assume the electrical functions. The trunk may be of solid construction, and is preferably in the form of a fiberglass reinforced rod as in the case of insulators for overhead lines, but the trunk may be hollow, as in the case of housing insulators. The umbrella-shaped sections of composite insulators of synthetic material are preferably moulded or cast onto the trunk subsequent to formation of the trunk and in a separate operation. For the moulding operation, the use of negative moulds is of questionable value. Use of such moulds necessitates high mould costs and is also very wasteful because of the long time periods during which the expensive moulds are occupied. In the case of divisible negative moulds, electrical disadvantages also arise because of the flash that is left after moulding. Above all, considerable work is involved in removal of the insulator sections from the moulds.

Attempts have already been made to produce disc or funnel-shaped umbrella-shaped insulators of synthetic material. These umbrellas are described in detail in British Pat. No. 1,066,209. According to that disclosure, the composite electric insulator consists of a fiberglass reinforced trunk which is completely or partly covered with sleeves of polymeric material. The sleeves are widened or flared, and they are placed on top of one another at one end of the trunk in order to form a chain of umbrella-shaped insulator sections. The sleeves or insulator sections may likewise have an internal screw thread that cooperates with a thread on the trunk. The insulator sections are then screwed together and cemented to the fiberglass rod with a suitable adhesive. Due to the flaring of the lower ends of the sleeves when they are mounted on the trunk, weak points result, and these eventually lead to intensified failures in use. In this case, the covering of the trunk is simply too thin, and the umbrella form of the insulator sections do not meet the requirements in practice. For this reason, this type of insulator is useful only for low voltage ranges.

According to German Pat. No. 2,044,179, a method is also known in which the casting of the umbrella-shaped insulator sections is effected using an open, undivided casting mould which is moved downwardly step by step following the casting of each umbrella-shaped insulator section along the vertically arranged fiberglass reinforced trunk of synthetic material. Gradually, all of the umbrella-shaped insulator sections of the insulator are formed by this one mould. In the process, through an upward and downward movement of the mould, the part of the trunk which is located between the umbrella-shaped insulator sections is covered with a layer of synthetic material by means of the liquid casting mass in the filled mould. This method is disadvantageous because of the great consumption of time and because before each insulator section is cast, it is necessary to wait for the preceding section to fully harden. In particular, it also is disadvantageous that by this method only umbrella shapes with a plane underside can be moulded. The formation of a so-called "protected surface-leakage path" is not possible.

The invention is designed for providing disc or funnel-shaped composite umbrella-shaped insulator sections of synthetic material which are formed on a fiberglass reinforced supporting trunk but which avoid the above-mentioned disadvantages. By the method of the invention for fixing the insulator sections to the trunk, it is furthermore intended that the umbrella shapes have a large so-called protected surface-leakage path. Moreover, a solution is sought for mounting umbrella-shaped insulator sections of different sizes or forms conveniently on the insulator trunk.

According to the invention, the problem is solved in that a prefabricated umbrella-shaped casting mould, which may be used only once, is comprised of a thin umbrella-contoured surface which leads into a tubular socket-shaped part. The latter part has suitably formed, inwardly facing centering aids and a sealing lip at its lower end. The cavity created between the trunk and the umbrella-shaped casting mould is partly or completely filled with a hardenable synthetic material which is similar in its elastic and thermal properties to the material of the mould, so that the umbrella-casting mould employed becomes an integral part of the insulator umbrella.

The method of the invention comprises fixing disc or funnel-shaped composite umbrella-shaped insulator sections of synthetic material to the fiberglass reinforced supporting trunk. The umbrella-shaped casting moulds may be of different sizes and/or different forms. They are stacked one immediately above the other and are permanently united with the supporting trunk simultaneously or in series in one operation by casting or injection of a hardenable synthetic material into all mould sections in the stack.

According to another idea of the invention, each umbrella-shaped mould may be open or closed at its flared end.

According to a constructional form of the invention, a one-part umbrella-shaped casting mould may be converted into a multi-part umbrella-shaped casting mould by means of exchangeable component parts which are cemented together or interlocked.

In addition, a prefabricated umbrella-shaped casting mould may also be provided with ribs for reinforcing purposes. In another preferred construction, the inner surface of the prefabricated umbrella-shape casting mould is roughened.

The above-described and other features of the invention are described more fully hereinafter with reference to embodiments shown in annexed drawing FIGS. 1 to 3.

Figure 1:
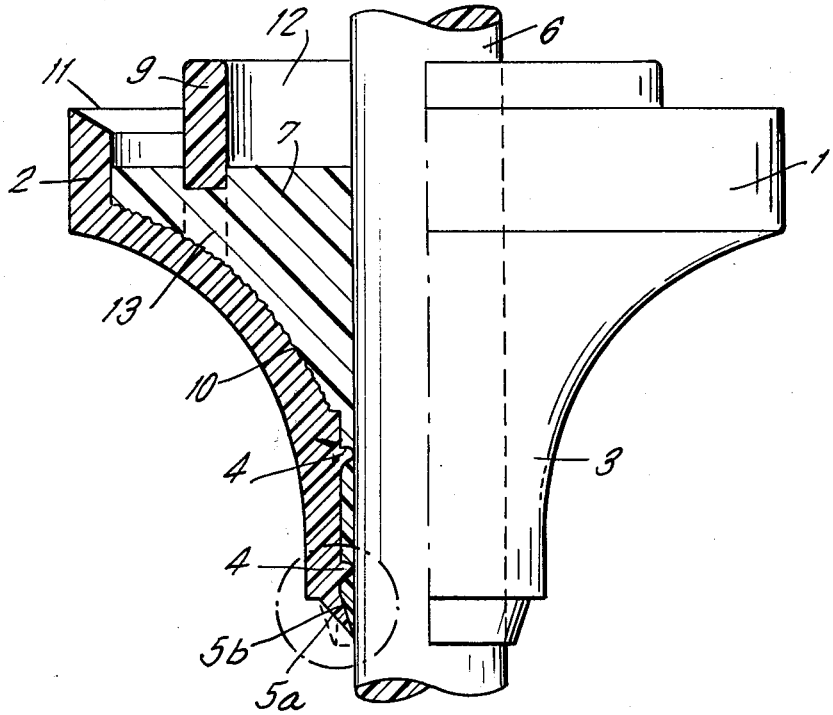
FIG. 1 is a cross-sectional elevational view through an open umbrella-shaped casting mould on an insulator trunk.
Figure 2:
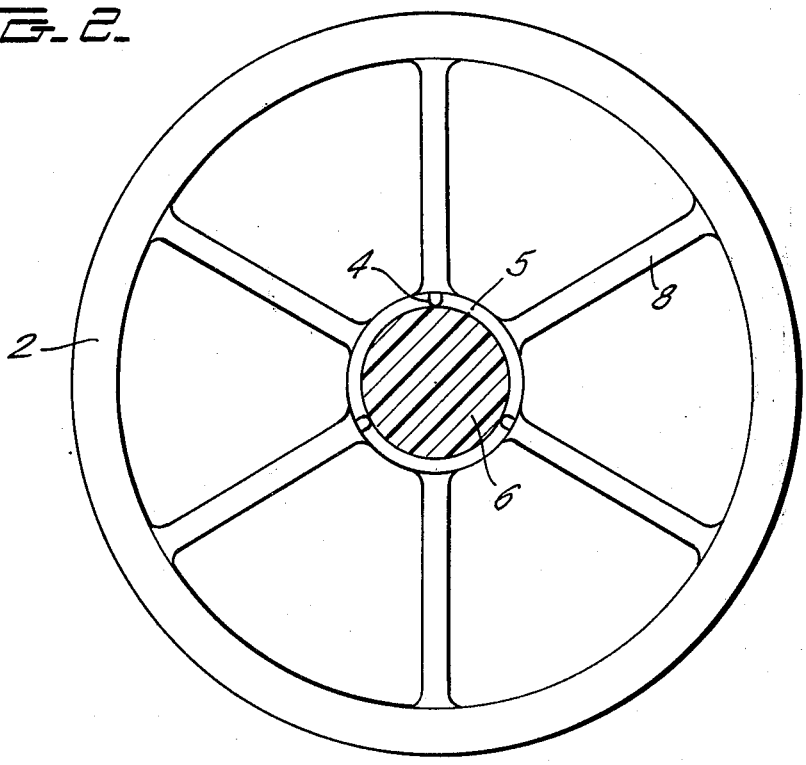
FIG. 2 is a plan view of an umbrella-shaped casting mould having reinforcing ribs.

In FIG. 1, the umbrella-shaped casting mould 1 is an open mould which is secured on the insulator trunk 6. More particularly, the umbrella-shaped casting mould 1 is comprised of a thin outer, generally umbrella-contoured surface 2 and a lower tubular socket-shaped part 3. Socket 3 is provided with internal centering aids 4, which, as shown in FIGS. 1 and 2, are bosses at spaced locations around socket 3. These centering aids 4 enable the umbrella-shaped casting mould 1 to be aligned on the trunk 6, yet they do not interfere with the filling of the mould by material 7. Preferably, a point bearing action is obtained from centering aids 4. At the lower end of the mould 1, there is also an annular sealing lip 5 which is either normally applied against the trunk 6 (position 5*a*) or is so designed that it applies itself against the trunk 6 only when the following or next in line casting mould is pushed upwardly (position 5*b*).

The mould 1 may be smooth or plain internally or it may be roughened or provided with grooves 10 to increase the area of contact with the filling material. In addition, the body of the mould 1 itself may be variously constructed and in particular it may be formed so that it is thick to a greater or lesser degree. In the extreme case of thickness, only the narrow gap between the casting mould and the core has to be filled with hardenable synthetic material. Depending upon the material used for or the thickness of the umbrella-shaped casting mould 1, it may also be necessary to provide it with reinforcements, for example by applying a plurality of reinforcing ribs 8 around mould 1, as can be seen in FIG. 2.

To obtain a larger surface leakage path, in particular a larger protected surface leakage path, the area within mould 1 is provided with one or more spaced-apart annular sleeves 9, which advantageously have a plurality of throughflow apertures 13 arrayed around and passing through the sleeve so that the entire filling of the umbrella-shaped mould can be achieved in a single filling operation. Sleeve 9 seats on interior surface 10 and projects up through the interior of mould 1. With umbrella-shaped casting mould 1 subdivided into two annular sections by means of an annular sleeve 9, as shown in FIG. 1, it is possible to obtain wide or upper or open-end umbrella surfaces 11 and 12 at different depths. This usually requires that sleeve 9 project above the top of surface 2 and that the area inside sleeve 9 be filled to a greater height than the area inside surface 2, which might be accomplished by allowing material to set in both annular sections and then further filling the radially inner section. This expedient produces at the same time the desired large protected surface leakage path.

Figure 3:
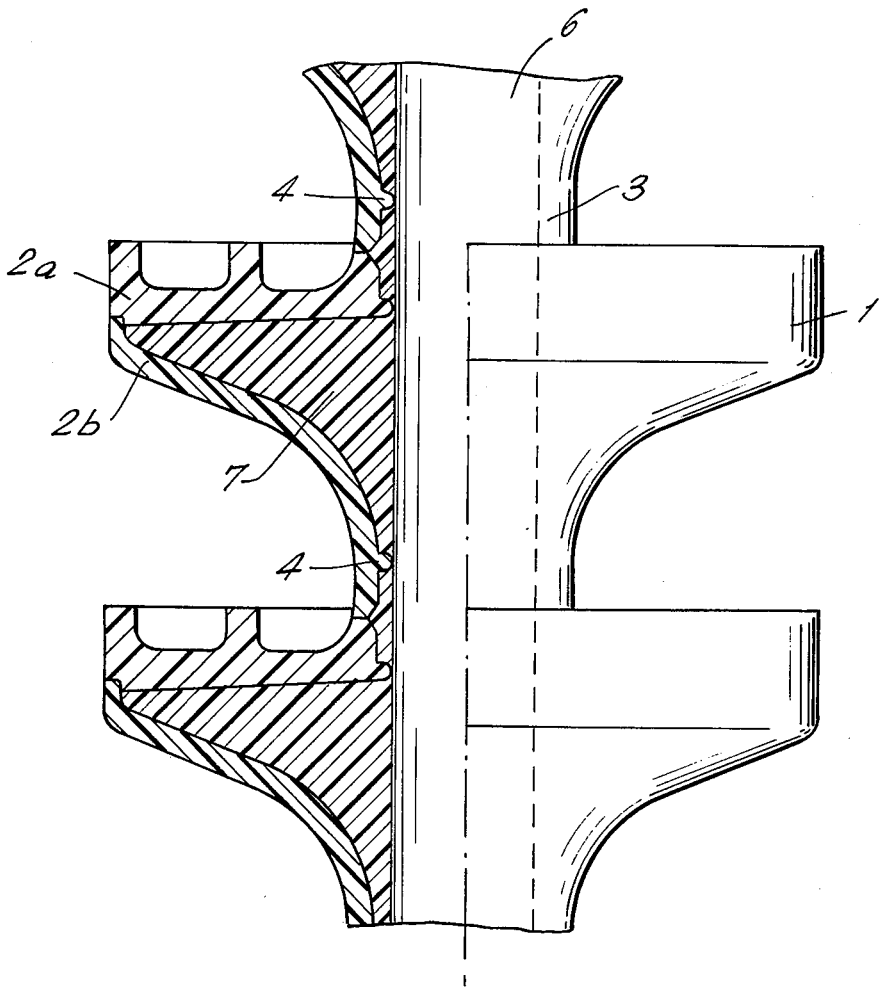
FIG. 3 is a section through closed umbrella-shaped casting moulds on an insulator trunk.

While FIG. 1 shows an open mould, FIG. 3 shows a closed casting mould. The umbrella-contoured surface 2 comprises in this case the generated umbrella-shaped surface or shell 2*b* and a top closing-off cover 2*a* applied thereto. If it is desired to cast a plurality of umbrella-shaped sections simultaneously onto the trunk, it is convenient to omit the sealing lip 5 as leakage along trunk 6 is not a problem during moulding of a set of insulator sections. This is also shown essentially in FIG. 3.

In selecting the hardenable synthetic material 7 between the casting mould 1 and the trunk 6, it is important that a satisfactory bond be obtained between the two materials of mould 1 and material 7. In this manner, after the synthetic material 7 has fully hardened, the umbrella-shaped casting mould 1 forms an integral part of the finished insulator umbrella. Moreover, there is a vital difference here from the umbrella-shaped casting moulds employed heretofore. With the previous moulds, care had to be taken to ensure satisfactory removability of the mould after the filling material had fully hardened. A type of material which meets all requirements that are placed upon an insulator section 7 material must be employed for the umbrella-shaped casting mould 1. The hardenable synthetic material should be chosen of the same kind as, or a similar kind to, the material for the umbrella-casting mould 1. Moreover, the filling material must be such that it ensures a satisfactory bond with the supporting trunk, so that the different mechanical and thermal expansion values of the supporting trunk 6 and the filling material 7 as well as of the umbrella-casting mould 1 do not permit any inadmissible weakening of the bond zone. For a synthetic material insulator which is resistant to outdoor atmospheric conditions, the umbrella material must, in particular, be non-tracking, resistant to hydrolysis, resistant to ultraviolet radiation and ozone and sufficiently strong mechanically. These requirements are filled in particular by a highly elastic filling material, such as, for example, cycloaliphatic epoxy resins, silicone rubber, butyl rubber, fluorosilicone polymer and polysulphides.

To produce a composite insulator with the umbrella-shaped sections according to the invention, one or more umbrella-shaped casting moulds 2*b* are pushed onto a vertically suspended trunk 6. The umbrella-shaped casting moulds are thereafter completely or partly filled simultaneously or in series with the hardenable synthetic material 7. In order to obtain a satisfactory composite insulator, it is important that the filling material enters free from voids, especially in the region having a narrowed gap, at the socket part 3, i.e. in the vicinity of the sealing lip 5. This aim is served by the already mentioned centering aids 4, which prevent a one-sided bearing action of the umbrella-casting mould against the trunk 6. Moreover, the gap between mould and trunk is kept free for the entry of the filling material. Depending on the nature and consistency of the filling material, it may be advantageous to effect the filling of the moulds under vacuum conditions, i.e. by reducing pressure in the mould cavity so as to achieve complete wetting of the trunk and uniform filling of the gap between the core 6 and the umbrella-shaped casting mould 1. Another advantageous method includes enabling a limited flow through the gap between the umbrella-casting mould 1 and the core 6 and ensuring sealing only after the filling material issues evenly at the lower end of the neck of the bottom mould 1, i.e. at lip 5. This may be done by pushing up the casting mould 1 located from below, with the sealing lip 5 then bearing against the trunk. Another possibility for producing a uniform filling comprises moving the umbrella-shaped casting mould 1 up and down on the trunk 6 after filling or, advantageously, placing the insulator to be filled on a vibrating or jolting stand. The desired lengthened protected surface-leakage path can be obtained either by means of a prefabricated cover 2a which, in accordance with FIG. 3, is applied to the lower or underside of each next higher umbrella mould 1 or by the above-suggested technique of forming different chambers within the area to be filled with hardenable material by means of an annular sleeve 9. These different chambers make levels of the filling material of different heights possible.

It is furthermore also convenient to prefabricate the different casting moulds for the umbrellas economically by isostatic pressing or pressure casting and after forming, to store them, so that the desired type of insulator can be produced relatively quickly. The umbrella-shaped casting moulds may be prefabricated in large numbers independently of the manufacture of the insulators. As a result, cheap moulding processes may be used.

The production time of an insulator according to the invention is substantially reduced. If an umbrella section forming material is employed which makes hardening or curing in a warming oven necessary, this step is required only a single time with the method proposed, whereas with the methods of the prior art, this had to be done with each individual umbrella-shaped section. Moreover, it is also possible to employ umbrella-shaped casting moulds of materials of the highest mechanical strength, whereby a further number of problems arising in practice are solved. Also, by using prefabricated umbrella-shaped casting moulds and by avoiding filling of each mould as far as its rim, satisfactory expansion of the cast umbrella-shaped sections is obtained. Particularly important, however, is the fact that an enlarged protected surface leakage path has been obtained at the underside of the umbrella, which has not been possible with methods heretofore known. Of further importance is also the thicker trunk transition between the umbrellas, at the roots or socket parts thereof, so that electrical breakdowns can be avoided at this point. Additionally, insulator sections with umbrella diameters of different sizes or different forms can easily be made. This can be used for insulators with so-called alternating umbrellas.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. A composite insulator, comprising:

an elongated support trunk;

a hollow, generally umbrella-shaped casting mould comprised of a synthetic material and extending annularly around and being gap spaced from said trunk; said mould narrowing gradually from said umbrella shape to a tubular socket part around said trunk; centering aids internally of said socket part for defining a gap space between said socket part and said trunk; means sealing said mould at the end thereof beyond said socket part;

a cavity including said gap space being defined between said mould and said trunk;

a hardenable synthetic material at least partly filling said cavity; said hardenable synthetic material having similar elastic and thermal properties to said mould synthetic material, and said mould being integrally joined to and being a nonremovable part of said insulator.

2. The composite insulator of claim 1, wherein said trunk is comprised of a fiberglass reinforced material.

3. The composite insulator of claim 1, wherein said mould has a wider end away from said socket part and said wider end is uncovered and open.

4. The composite insulator of claim 3, further comprising covering means covering said open wider mould end and sealing that said end closed.

5. The composite insulator of claim 3, further comprising an annular sleeve located in said mould and extending from the inside surface of said mould, through the inside of said mould and at least through said open wider end of said mould; said sleeve dividing the interior of said mould into a first annular section between said sleeve and said trunk and a second annular section of said mould between said sleeve and said mould.

6. The composite insulator of claim 1, further comprising mould reinforcing ribs on the interior surface of said mould.

7. The composite insulator of claim 1, wherein the interior surface of said mould is roughened.

8. The composite insulator of claim 1, wherein said mould and said hardenable material in said mould are both comprised of one of the group of materials consisting of cycloaliphatic epoxy resins and silicone rubber.

9. The composite insulator of claim 1, wherein said mould is comprised of one of the group of materials consisting of butyl rubber, fluorosilicone polymers and polysulphides.

* * * * *